US008614697B2

(12) United States Patent
Kim et al.

(10) Patent No.: US 8,614,697 B2
(45) Date of Patent: Dec. 24, 2013

(54) DISPLAY APPARATUS AND METHOD OF DRIVING THE SAME

(75) Inventors: Hyoung-Hak Kim, Cheonan-si (KR); Sang-Hoon Park, Suwon-si (KR); Kyu-Jin Park, Ansan-si (KR); Kyu-Hun Lim, Chungcheongnam-do (KR); Sun-Mi Son, Seoul (KR)

(73) Assignee: Samsung Display Co., Ltd. (KR)

( * ) Notice: Subject to any disclaimer, the term of this patent is extended or adjusted under 35 U.S.C. 154(b) by 525 days.

(21) Appl. No.: 12/416,446

(22) Filed: Apr. 1, 2009

(65) Prior Publication Data

US 2010/0066708 A1 Mar. 18, 2010

(30) Foreign Application Priority Data

Sep. 17, 2008 (KR) ..... 10-2008-0091220

(51) Int. Cl.
*G09G 3/36* (2006.01)

(52) U.S. Cl.
USPC ..... 345/204; 345/87; 345/99

(58) Field of Classification Search
USPC ..... 345/204
See application file for complete search history.

(56) References Cited

U.S. PATENT DOCUMENTS

| | | | | |
|---|---|---|---|---|
| 6,407,729 | B1 * | 6/2002 | Moon | 345/99 |
| 2005/0007324 | A1 * | 1/2005 | Inada | 345/87 |

FOREIGN PATENT DOCUMENTS

| | | | |
|---|---|---|---|
| JP | 04247491 | A | 9/1992 |
| JP | 06230340 | A | 8/1994 |
| JP | 2001215469 | A | 8/2001 |
| JP | 2002366113 | A | 12/2002 |
| JP | 2005128153 | A | 5/2005 |
| KR | 1020010048871 | | 6/2001 |
| KR | 1020050112903 | | 12/2005 |
| KR | 1020070034381 | | 3/2007 |
| KR | 1020070074176 | | 7/2007 |

* cited by examiner

*Primary Examiner* — Sumati Lefkowitz
*Assistant Examiner* — Jose Soto Lopez
(74) *Attorney, Agent, or Firm* — Cantor Colburn LLP

(57) ABSTRACT

A display apparatus includes a timing controller which outputs image data, a data control signal and a first gate control signal, a data driving circuit which receives the image data and converts the image data into data voltages, a control signal converting circuit which delays the first gate control signal by a reference time period to convert the first gate control signal into a second gate control signal based on a reference signal, a gate driving circuit which outputs gate signals based on the second gate control signal, and a display panel which displays an image corresponding to the one line of the data voltages based on the gate signals. Each gate signal rises at a point in time delayed from a starting point of a corresponding horizontal scanning period by the reference time period and falls before an ending point of the corresponding horizontal scanning period.

16 Claims, 6 Drawing Sheets

DISPLAY APPARATUS AND METHOD OF DRIVING THE SAME

This application claims priority to Korean Patent Application No. 2008-0091220, filed on Sep. 17, 2008, and all the benefits accruing therefrom under 35 U.S.C. §119, the contents of which in its entirety are herein incorporated by reference.

BACKGROUND OF THE INVENTION

1. Field of the Invention

The present invention relates to a display apparatus and a method of driving the same. More particularly, the present invention relates to a display apparatus and method of driving the display apparatus in an inversion drive scheme.

2. Description of the Related Art

In general, a liquid crystal display ("LCD") includes a color filter substrate, an array substrate disposed opposite to the color filter substrate, and a liquid crystal layer interposed between the color filter substrate and the array substrate. The color filter substrate includes a color filter layer and a common electrode, and the array substrate includes a pixel electrode facing the common electrode.

The common electrode receives a common voltage, and the pixel electrode receives a data voltage. An electric field, corresponding to a voltage difference between the data voltage and the common voltage, is formed between the pixel electrode and the common electrode. Liquid crystal molecules included in the liquid crystal layer are aligned by the electric field. As a result, the LCD controls light transmittance of the liquid crystal layer to display a desired image on the LCD.

However, when a data voltage having a same polarity as the common voltage is continuously applied to the pixel electrode every frame, the liquid crystal molecules included in the liquid crystal layer deteriorate. To prevent the deterioration of the liquid crystal molecules, an LCD is driven in an inversion drive scheme.

The inversion drive scheme is classified as either a frame inversion drive scheme, a line inversion drive scheme, a one-dot inversion drive scheme, or a two-dot inversion drive scheme. Specifically, in the frame inversion drive scheme, a polarity of the data voltage (with respect to the common voltage having a direct-current voltage) is inverted every frame. In the line inversion drive scheme, a polarity of the data voltage (with respect to the common voltage having an alternating-current voltage) is inverted every one or more lines. In the one-dot and the two-dot inversion drive schemes, a polarity of the data voltage is inverted every one pixel or every two pixels.

However, in an LCD utilizing the inversion drive scheme, distortion of the common voltage occurs at a time point at which the polarity of the data voltage is inverted. As a result, a crosstalk phenomenon and/or a greenish display phenomenon occur on a screen of the LCD, thereby substantially deteriorating a display quality of the LCD.

BRIEF SUMMARY OF THE INVENTION

An exemplary embodiment of the present invention provides a display apparatus having a substantially reduced and/or effectively prevented crosstalk and/or a greenish display phenomenon, resulting in a substantially improved display quality of the display apparatus.

An alternative exemplary embodiment of the present invention provides a method of driving the display apparatus.

In an exemplary embodiment of the present invention, a display apparatus includes a timing controller, a data driving circuit, a control signal converting circuit, a gate driving circuit and a display panel.

The timing controller outputs image data, a data control signal and a first gate control signal. The data driving circuit receives the image data in synchronization with the data control signal to convert the image data into data voltages, and outputs one line of data voltages each horizontal scanning period.

The control signal converting circuit outputs a second gate control signal delayed by a reference time period from the first gate control signal based on a predetermined reference signal. The gate driving circuit sequentially outputs gate signals in response to the second gate control signal.

The display panel has a plurality of pixel rows which display an image corresponding to the one line of the data voltages in response to the gate signals.

Each gate signal of the gate signals rises at a point in time delayed by the reference time period from a starting point of a corresponding horizontal scanning period and falls before an ending point of the corresponding horizontal scanning period.

In an alternative exemplary embodiment of the present invention, a method of driving a display apparatus includes generating image data, a data control signal and a first gate control signal converting the image data into data voltages in synchronization with the data control signal to output one line of the data voltages each horizontal scanning period, delaying the first gate control signal by a reference time period based on a reference signal to output a second gate control signal, sequentially outputting gate signals in response to the second gate control signal, and displaying an image corresponding to the one line of the data voltages in response to the gate signals.

Each gate signal of the gate signals rises at a point in time delayed by the reference time period from a starting point of a corresponding horizontal scanning period and falls before an ending point of the corresponding horizontal scanning period.

According to exemplary embodiments of the present invention, a display apparatus generates a second gate control signal delayed by a reference time period from a first gate control signal generated by a timing controller, and generates gate signals in response to the second gate control signal. Thus, each gate signal rises at a point in time delayed by the reference time period from a starting point of a corresponding horizontal scanning period and falls before an ending point of the corresponding horizontal scanning period.

As a result, each pixel is not affected by distortion of a common voltage generated during a period after the starting time point of the horizontal scanning period, thereby effectively preventing a crosstalk phenomenon and/or a greenish display phenomenon.

BRIEF DESCRIPTION OF THE DRAWINGS

The above and other aspects, features and advantages of the present invention will become more readily apparent by describing in further detail exemplary embodiments thereof with reference to the accompanying drawings, in which.

DETAILED DESCRIPTION OF THE INVENTION

Figure 1:
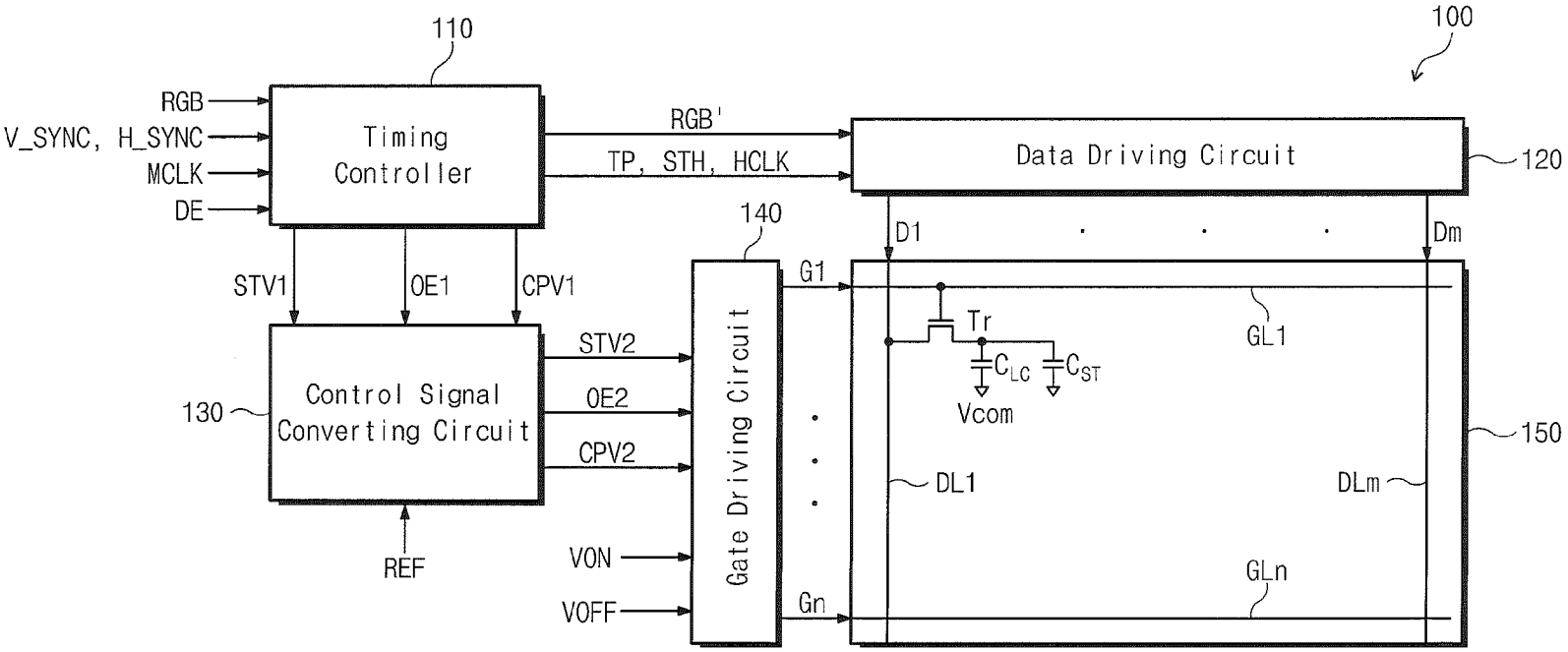
FIG. 1 is a block diagram of an exemplary embodiment of a liquid crystal display ("LCD") according to the present invention.

The invention will now be described more fully hereinafter with reference to the accompanying drawings, in which exemplary embodiments of the invention are shown. The present invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including," when used in this specification, specify the presence of stated features, regions, integers, steps, operations, elements and/or components, but do not preclude the presence or addition of one or more other features, regions, integers, steps, operations, elements, components and/or groups thereof.

Furthermore, relative terms, such as "lower" or "bottom" and "upper" or "top" may be used herein to describe one element's relationship to other elements as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on the "upper" side of the other elements. The exemplary term "lower" can, therefore, encompass both an orientation of "lower" and "upper," depending upon the particular orientation of the figure. Similarly, if the device in one of the figures were turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning which is consistent with their meaning in the context of the relevant art and the present disclosure, and will not be interpreted in an idealized or overly formal sense unless expressly so defined herein.

Exemplary embodiments of the present invention are described herein with reference to cross section illustrations which are schematic illustrations of idealized embodiments of the present invention. As such, variations from the shapes of the illustrations as a result, for example, of manufacturing techniques and/or tolerances, are to be expected. Thus, embodiments of the present invention should not be construed as limited to the particular shapes of regions illustrated herein but are to include deviations in shapes which result, for example, from manufacturing. For example, a region illustrated or described as flat may, typically, have rough and/or nonlinear features. Moreover, sharp angles which are illustrated may be rounded. Thus, the regions illustrated in the figures are schematic in nature and their shapes are not intended to illustrate the precise shape of a region and are not intended to limit the scope of the present invention.

Hereinafter, exemplary embodiments of the present invention will be described in further detail with reference to the accompanying drawings.

FIG. 1 is a block diagram of an exemplary embodiment of a liquid crystal display ("LCD") according to the present invention.

Referring to FIG. 1, an LCD 100 according to an exemplary embodiment includes a timing controller 110, a data driving circuit 120, a control signal converting circuit 130, a gate driving circuit 140 and a liquid crystal panel 150.

The timing controller 110 receives image data RGB, a horizontal synchronization signal H_SYNC, a vertical synchronization signal V_SYNC, a main clock signal MCLK and a data enable signal DE. The timing controller 110 converts the image data RGB from a first data format into a second data format, the second data format corresponding to an interface between the data driving circuit 120 and the timing controller 110, and outputs image data RGB' in the second data format, e.g., a converted data format, and data control signals. In an exemplary embodiment, the data control signals may include an output starting signal TP, a horizontal starting signal STH and a horizontal clock signal HCLK.

The data driving circuit 120 generates data voltages D1-Dm using gamma voltages supplied from a gamma voltage generator (not shown). Specifically, the data driving circuit 120 selects gamma voltages corresponding to the image data RGB' in response to the data control signals, e.g., the output starting signal TP, the horizontal starting signal STH and the horizontal clock signal HCLK, and outputs the selected gamma voltages as the data voltages D1-Dm.

The timing controller 110 outputs a first gate control signal to the control signal converting circuit 130. In an exemplary embodiment, the first gate control signal includes a first vertical starting signal STV1, a first gate clock signal CPV1 and a first output enable signal OE1.

The control signal converting circuit 130 converts the first gate control signal from the timing controller 110 into a second gate control signal based on a reference signal REF. The second gate control signal according to an exemplary embodiment includes a second vertical starting signal STV2, a second gate clock signal CPV2 and a second output enable signal OE2.

The reference signal REF is supplied from an electrically erasable programmable read-only memory ("EEPROM") (not shown) which stores information about the LCD 100. In an exemplary embodiment, the control signal converting circuit 130 may further receive an oscillator clock to convert a frequency of the first gate control signal. In this case, the control signal converting circuit 130 increases or, alternatively, decreases the frequency of the first gate control signal using the oscillator clock, and the control signal converting circuit 130 may output the second gate control signal having a frequency different from the first gate control signal.

More specifically, the control signal converting circuit 130 delays the first gate control signal by a reference time period based on the reference signal REF to convert the first gate control signal into the second gate control signal. As a result, the second vertical starting signal STV2, the second gate clock signal CPV2 and the second output enable signal OE2 are delayed by the reference time period from the first vertical start signal STV1, the first gate clock signal CPV1 and the first output enable signal OE1, respectively, as will be described in further detail below.

The gate driving circuit 140 sequentially outputs gate signals G1-Gn in response to the second gate control signal. Each gate signal Gn of the gate signals G1-Gn maintains a gate on voltage VON during a predetermined period (hereinafter, referred to as a "high period") of one frame and a gate off voltage VOFF during a remaining period of the one frame.

The gate signals G1-Gn generated by the second gate control signal are delayed by the reference time period (as compared to the first gate control signal), and the high period in each gate signal begins at a point in time after the reference time from a point in time at which the data voltages D1-Dm are outputted from the data driving circuit 120.

Still referring to FIG. 1, the liquid crystal panel 150 according to an exemplary embodiment further includes gate lines GL1-GLn, data lines DL1-DLm substantially perpendicular to, e.g., crossing, the gate lines GL1-GLn, and a plurality of pixels. In an exemplary embodiment, pixels of the plurality of pixels are arranged in pixel areas defined by the gate lines GL1-GLn and the data lines DL1-DLm. Each pixel has a thin film transistor Tr, a liquid crystal capacitor $C_{LC}$ and a storage capacitor $C_{ST}$. The thin film transistor Tr includes a gate electrode connected to a corresponding gate line of the gate lines GL1-GLn, a source electrode connected to a corresponding data line of the data lines DL1-DLm, a drain electrode connected to the liquid crystal capacitor $C_{LC}$ and the storage capacitor $C_{ST}$. The liquid crystal capacitor $C_{LC}$ includes a first electrode connected to the drain electrode and a second electrode connected to a common electrode which receives a common voltage Vcom.

The gate lines GL1-GLn are connected to the gate driving circuit 140 and sequentially receive the gate signals G1-Gn, respectively, from the gate driving circuit 140. The data lines DL1-DLm are connected to the data driving circuit 120 and receive the data voltages D1-Dm, respectively, from the data driving circuit 120. When the reference time period elapses after the data voltages D1-Dm from the data driving circuit 120 are applied to the data lines DL1-DLm, respectively, the gate lines GL1-GLn are sequentially selected by the gate signals G1-Gn, respectively. A thin film transistor Tr connected to a corresponding selected gate line is turned on, and the corresponding data voltage supplied to each data line is applied to a corresponding liquid crystal capacitor $C_{LC}$ and storage capacitor $C_{ST}$ through the turned-on thin film transistor Tr.

The data lines DL1-DLm are pre-charged by the data voltages D1-Dm, respectively, before the corresponding thin film transistors Tr are turned on, so that, after the thin film transistor Tr is turned on, a time required to charge the liquid crystal capacitor $C_{LC}$ with a corresponding data voltage is substantially reduced.

The liquid crystal capacitor $C_{LC}$ controls a transmittance of light supplied to the liquid crystal panel 150 based on the data voltage provided via the turned-on thin film transistor Tr, and the liquid crystal panel 150 thereby displays a desired image. The storage capacitor $C_{ST}$ stores the data voltage which is provided when the thin film transistor Tr is turned on. When the thin film transistor Tr is turned off, the storage capacitor $C_{ST}$ supplies the stored data voltage to the liquid crystal capacitor $C_{LC}$. Thus, although the thin film transistor Tr is turned off, the data voltage is continuously applied to the liquid crystal capacitor $C_{LC}$, and the liquid crystal panel 150 maintains display of the desired image.

In operation, a polarity (with respect to the common voltage Vcom) of each of the data voltages D1-Dm is inverted for each pixel row (or rows), and each pixel column (or columns). In an exemplary embodiment, for example, when polarities of the data voltages D1-Dm are inverted every two pixel rows, the data driving circuit 120 receives gamma voltages which are inverted (with respect to the common voltage Vcom) every two horizontal scanning periods. Thus, during two successive horizontal scanning periods, the data driving circuit 120 selects gamma voltages from the gamma voltages having a positive polarity, which correspond to the image data RGB', and outputs the selected gamma voltages as the data voltages D1-Dm. Thereafter, during two subsequent horizontal scanning periods, the data driving circuit 120 selects gamma voltages from the gamma voltages having a negative polarity, which correspond to the image data RGB', and outputs the selected gamma voltages as the data voltages D1-Dm. Thus, the liquid crystal panel 150 according to an exemplary embodiment is driven by a 2×1-dot inversion drive scheme.

Figure 2:
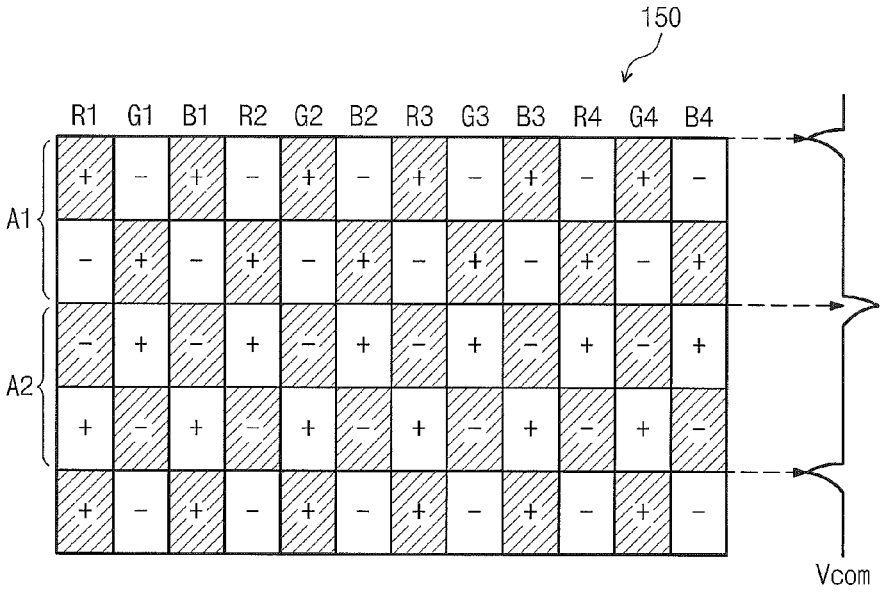
FIG. 2 is a plan view of a pattern which causes a greenish display phenomenon and a crosstalk phenomenon on a liquid crystal panel of the LCD shown in FIG. 1 when driven by a 2×1-dot inversion drive scheme.

FIG. 2 is a plan view of a pattern which causes a greenish display phenomenon and a crosstalk phenomenon on a liquid crystal panel driven by a 2×1-dot inversion drive scheme.

Referring to FIG. 2, a black gray scale area and a white gray scale area are alternately displayed every pixel row and pixel column on the liquid crystal panel 150 which is driven by the 2×1-dot inversion drive scheme.

More particularly, in a first pixel row, black data voltages having a positive polarity are applied to pixels R1, B1, G2, R3, B3 and G4, and white data voltages having a negative polarity are applied to pixels G1, R2, B2, G3, R4 and B4. Likewise, in a second pixel row, the black data voltages having the positive polarity are applied to the pixels G1, R2, B2, G3, R4 and B4, and the white data voltages having the negative polarity are applied to the pixels R1, B1, G2, R3, B3 and G4. In a third pixel row, the black data voltages having the negative polarity are applied to the pixels R1, B1, G2, R3, B3 and G4, and the white data voltages having the positive polarity are applied to the pixels G1, R2, B2, G3, R4 and B4. In a fourth pixel row, the black data voltages having the negative polarity are applied to the pixels G1, R2, B2, G3, R4 and B4, and the white data voltages having the positive polarity are applied to the pixels R1, B1, G2, R3, B3 and G4.

For purposes of explanation, the first pixel row and the second pixel row are herein referred to as a first area A1, and the third pixel row and the fourth pixel row are herein referred to as a second area A2. In an exemplary embodiment, since the black gray scale areas in the first area A1 all have the positive polarity, the common voltage Vcom is distorted between the second pixel row and the third pixel row, thereby rising, e.g., causing an increase or distortion in, the common voltage Vcom. Also, since the black gray scale areas in the second area A2 have the negative polarity, the common voltage Vcom is distorted between the fourth pixel row and a fifth pixel row, thereby falling, e.g., causing a decrease or distortion in, the common voltage Vcom, as shown in FIG. 2.

When the common voltage Vcom is distorted, as described above, a voltage value charged into each pixel increases or decreases as the level of the common voltage Vcom increases or decreases, respectively, as a result of the distortion. Therefore, a greenish phenomenon and/or a crosstalk phenomenon occur on the liquid crystal panel 150.

Figure 3:
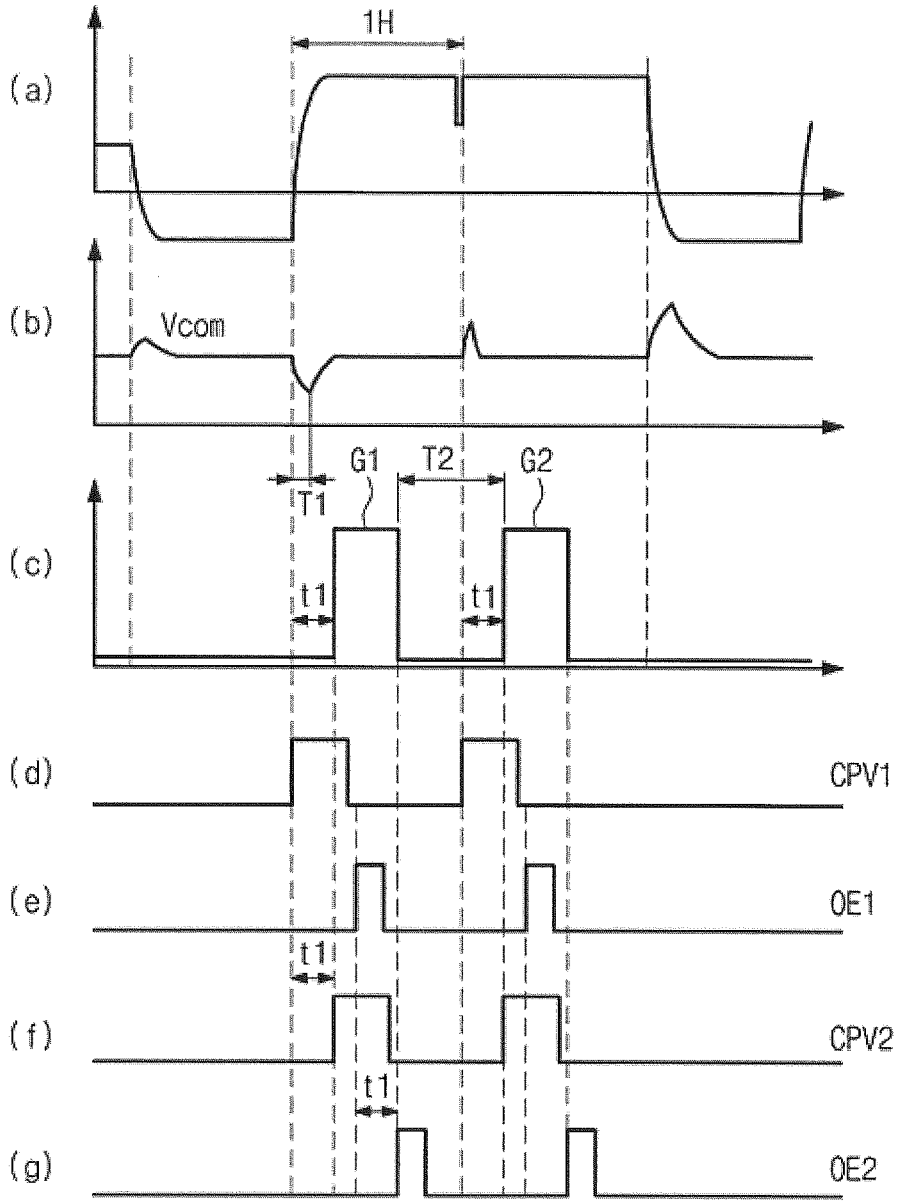
FIGS. 3(*a*) to 3(*g*) are signal timing diagrams of the LCD shown in FIG. 1.

FIGS. 3(*a*) to 3(*g*) are signal timing diagrams of an exemplary embodiment of an LCD according to the present invention. Specifically FIG. 3(*a*) is a waveform diagram of a data voltage over time, FIG. 3(*b*) is a waveform diagram of a common voltage over time, FIG. 3(*c*) is a waveform diagram of a first gate signal and a second gate signal over time, FIG. 3(*d*) is a waveform diagram of a first vertical clock signal over time, FIG. 3(*e*) is a waveform diagram of a first output enable signal over time, FIG. 3(*f*) is a waveform diagram of a second vertical clock signal over time, and FIG. 3(*g*) is a waveform diagram of a second output enable signal over time.

Referring to FIGS. 3(*a*) to 3(*g*), the data driving circuit 120 according to an exemplary embodiment (FIG. 1) outputs data voltages to the data lines DL1-DLm (FIG. 1) each horizontal scanning period 1 H. Specifically, FIG. 3(*a*) shows a data voltage applied to one data line of the data lines DL1-DLm.

Moreover, as shown in FIG. 3 (*a*), a polarity of the data voltage is inverted every two horizontal scanning periods (e.g., every 2 H).

In addition, as shown in FIG. 3(*a*), a present data voltage, having the positive polarity, is applied to the data line during a present horizontal scanning period 1 H, and thereafter, a next data voltage, e.g., a subsequent data voltage, having the same polarity and voltage level as the present data voltage is applied to the data line.

Referring to FIGS. 3(*a*) and 3(*b*), a first gate signal G1 is outputted from the gate driving circuit 140 after the present horizontal scanning period 1 H starts, and then a predetermined time (hereinafter, referred to as a reference time period t1) elapses. Accordingly, a pixel row connected to a first gate line GL1 (FIG. 1) selected by the first gate signal G1 is turned on and thereby receives the present data voltage.

After the next horizontal scanning period starts and the reference time period t1 elapses, a second gate signal G2 is outputted from the gate driving circuit 140. Thus, a pixel row connected to a second gate line GL2 (FIG. 1) selected by the second gate signal G2 is turned on to receive the next data voltage.

As shown in FIG. 3(*b*), distortion of the common voltage Vcom occurs at a starting point of the horizontal scanning period 1 H. The distortion of the common voltage Vcom occurs after a time interval from a starting point of the horizontal scanning period 1 H (hereinafter, referred to as a "distortion period"). More particularly, when a pattern such as described above with reference to FIG. 2 is displayed on the liquid crystal panel 150, the distortion of the common voltage Vcom substantially increases at the starting point of the horizontal scanning period 1 H.

In an exemplary embodiment, the distortion of the common voltage Vcom is substantially reduced and/or effectively decreased, since the first gate signal G1 is generated at a point in time after the reference time period t1 from the starting time point of the present horizontal scanning period 1 H.

Moreover, in an exemplary embodiment, the reference time period t1 is defined as a time period greater than a time period (hereinafter, referred to as a first time period T1) between the starting time point of the horizontal scanning period 1 H and the time point at which the distortion of the common voltage Vcom is at a greatest magnitude. In an exemplary embodiment, the first time period T1 is about 2 μs to about 3 μs, and the reference time period t1 is about 2 μs.

However, when a time period between a falling time point of the first gate signal G1 and a rising time point of the second gate signal G2 is defined as a second time period T2, a duration of the reference time period t1 does not exceed a duration of the second time period T2. Specifically, if the duration of the reference time period t1 exceeds the duration of the second time period T2, the first gate signal G1 overlaps the next horizontal scanning period 1 H, and two data adjacent subsequent voltages are applied to one pixel row.

Therefore, in an exemplary embodiment, the duration of the reference time period t1 is less than the duration of the second time period T2. Specifically, in an exemplary embodiment, when the duration of the second time period T2 is about 5 μs, the reference time period t1 may have a time length, e.g., a duration, of about 2 μs to about 5 μs.

To substantially prevent the pixels from being affected by the distortion of the common voltage Vcom, the gate driving circuit 140 generates the gate signals G1-Gn in a period other than a distortion period of the common voltage Vcom. Therefore, the gate driving circuit 140 according to an exemplary embodiment receives the second vertical clock signal CPV2 and the second output enable signal OE2.

As shown in FIGS. 3(*d*) to FIG. 3(*g*), a first high period of the second vertical clock signal CPV2 determines the rising time point of the first gate signal G1 and starts after the reference time period t1 from a first starting time point of the first vertical clock signal CPV1. Similarly, a first high period of the second output enable signal OE2 determines the falling time point of the first gate signal G1 and starts after the reference time period t1 from a first high period of the first output enable signal OE1. Likewise, remaining high periods of the second vertical clock signal CPV2 and remaining high periods of the second output enable signal OE2 are delayed by the reference time period t1.

Thus, the gate driving circuit 140 according to an exemplary embodiment generates the first gate signal G1 and the second gate signal G2, delayed by the reference time period t1 from the starting time point of the horizontal scanning periods corresponding thereto, in response to the delayed second vertical clock signal CPV2 and the delayed second output enable signal OE2. As a result, the crosstalk phenomenon and the greenish phenomenon are effectively prevented from occurring in the LCD 100 according to an exemplary embodiment, caused by the distortion of the common voltage Vcom.

Figure 4:
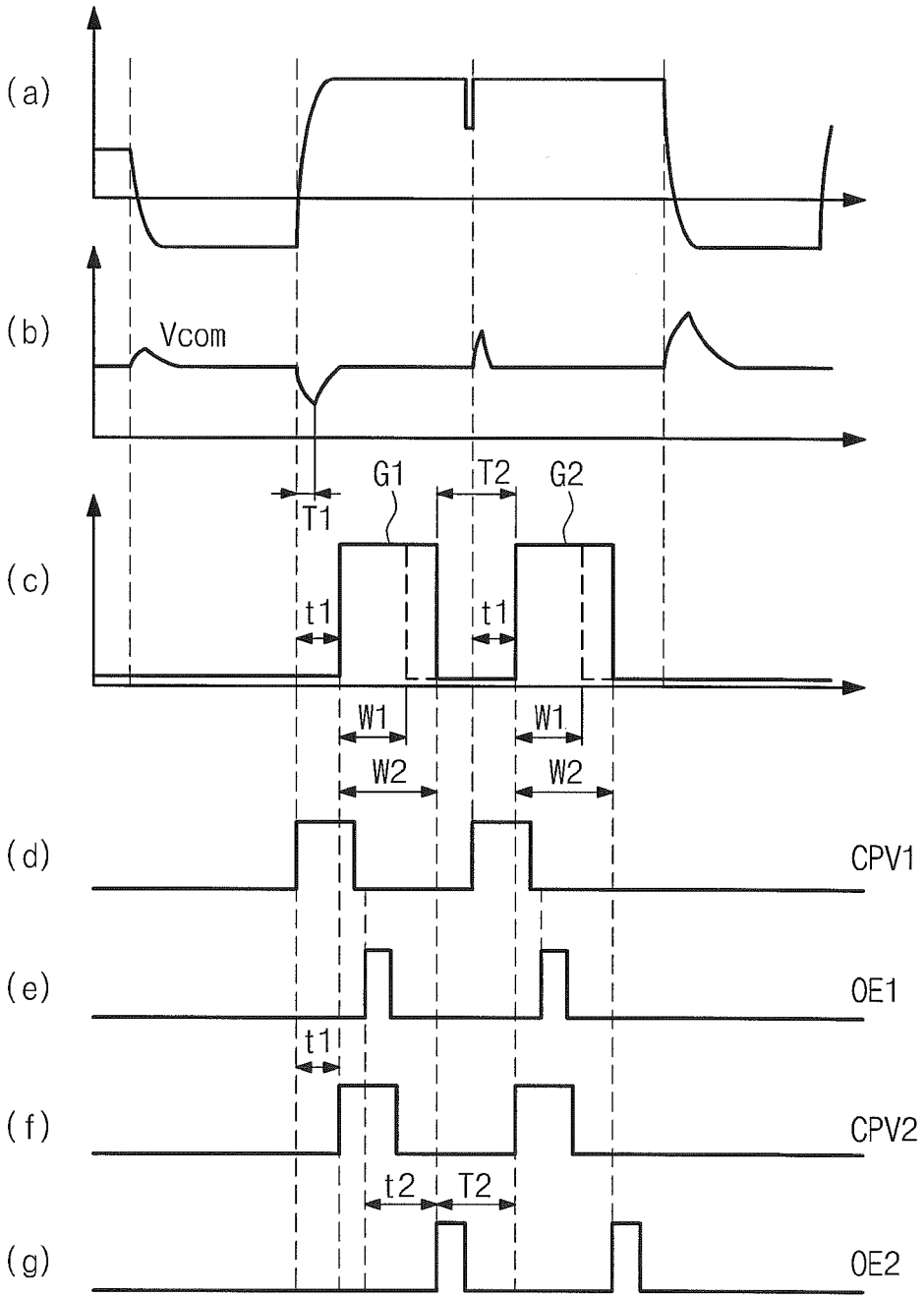
FIGS. 4(*a*) to 4(*g*) are signal timing diagrams of an alternative exemplary embodiment of an LCD according to the present invention.

FIGS. 4(*a*) to 4(*g*) are signal timing diagrams of an alternative exemplary embodiment of an LCD according to the present invention. Specifically, FIG. 4(*a*) is a waveform diagram of a data voltage over time, FIG. 4(*b*) is a waveform diagram of a common voltage over time, FIG. 4(*c*) is a waveform diagram of a first gate signal and a second gate signal over time, FIG. 4(*d*) is a waveform diagram of a first vertical clock signal over time, FIG. 4(*e*) is a waveform diagram of a first output enable signal over time, FIG. 4(*f*) is a waveform diagram of a second vertical clock signal over time, and FIG. 4(*g*) is a waveform diagram of a second output enable signal over time.

Referring to FIGS. 4(*a*) to 4(*g*), a first gate signal G1 and a second gate signal G2 have a pulse width W2. In an exemplary embodiment, the pulse width W2 is greater than a pulse width W1 of the first gate signal G1 and the second gate signal G2 described above with reference to FIGS. 3(*a*) to 3(*g*).

When a time period between a falling time point of the first gate signal G1 and a rising time point of the second gate signal G2 is defined as a second time period T2, the pulse width W2 of the first gate signal G1 and the second gate signal G2 increases unless the second time period T2 is equal to or less than about 4 μs.

As shown in FIGS. 4(*d*) to FIG. 4(*g*), a first high period of the second vertical clock signal CPV2, which determines the rising time point of the first gate signal G1, starts the reference time period t1 from a first starting time point of the first vertical clock signal CPV1. Accordingly, the first gate signal G1 is generated after the reference time period t1 from the starting time point of the horizontal scanning periods corresponding thereto.

In addition, a first high period of the second output enable signal OE2, which determines the falling time point of the first gate signal G1, starts after a third time period t2 which is greater than the reference time period t1 from a first high period of the first output enable signal OE1. Thus, a pulse width of the first gate signal G1 increases. In an exemplary embodiment, a time period between a rising time point of the second output enable signal OE2 and a rising time point of the second vertical clock signal CPV2 is maintained at a value equal to or greater than about 4 μs.

When the pulse width W2 of the first gate signal G1 and the second gate signal G2 increases, a time required to charge each pixel increases, thereby effectively preventing charging defects from occurring in each pixel.

Figure 5:
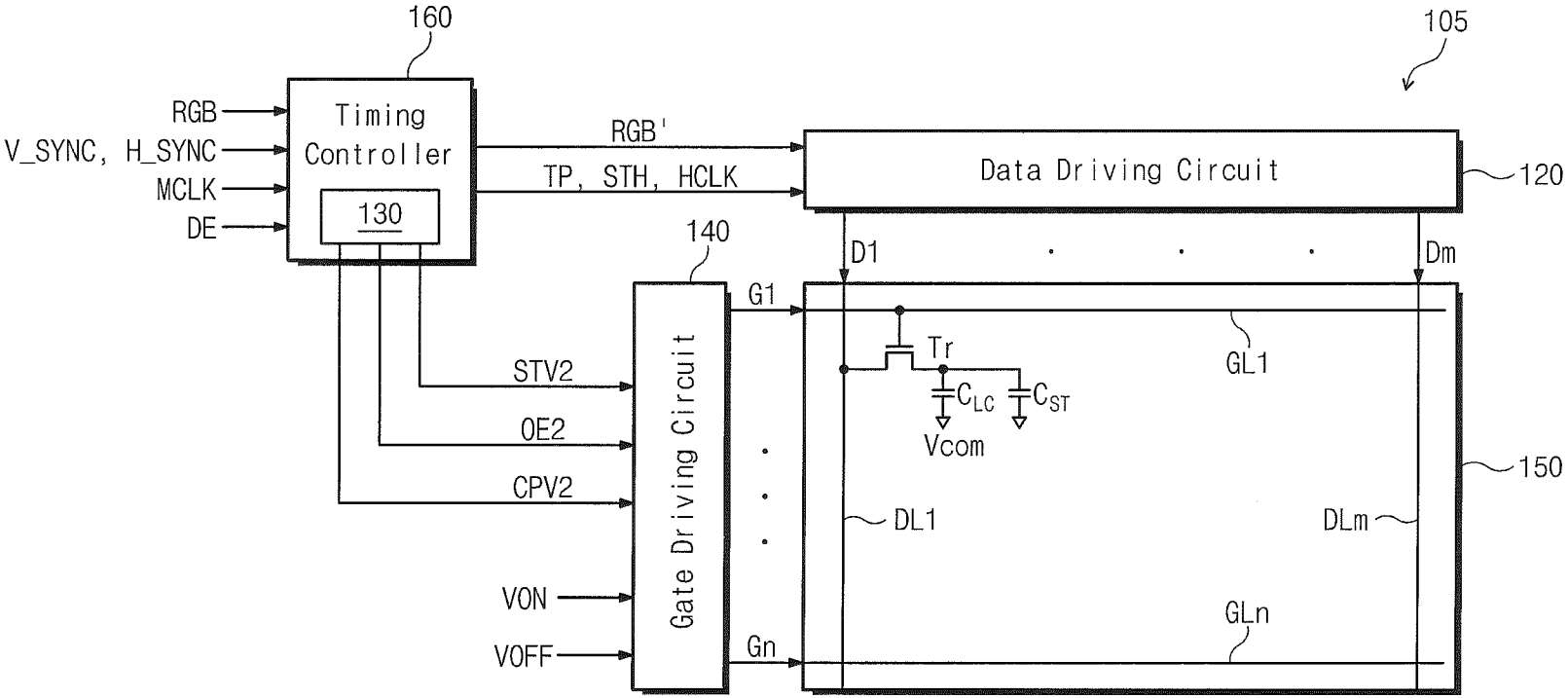
FIG. 5 is a block diagram of an alternative exemplary embodiment of an LCD according to the present invention.

FIG. 5 is a block diagram of an alternative exemplary embodiment of an LCD according to the present invention. In FIG. 5, the liquid crystal panel 150, the gate driving circuit 140 and the data driving circuit 120 have substantially the same structure and function as those described in greater detail above with reference to FIG. 1. Accordingly, the same reference numerals in FIG. 5 denote the same or like elements as shown in FIG. 1, and any detailed repetitive description thereof will hereinafter be omitted.

Referring to FIG. 5, an LCD 105 according to an exemplary embodiment includes the timing controller 160, the data driving circuit 120, the gate driving circuit 140 and the liquid crystal panel 150.

The timing controller 160 includes the control signal converting circuit 130 installed therein. Thus, the timing controller 160 converts the first gate control signal, e.g., the first vertical starting signal STV1, the first output enable signal OE1 and the first gate clock signal CPV1, into the second gate control signal, e.g., the second vertical starting signal STV2, the second output enable signal OE2 and the second gate clock signal CPV2, using the control signal converting circuit 130, and outputs the second gate control signal, e.g., the second vertical starting signal STV2, the second output enable signal OE2 and the second gate clock signal CPV2, to the gate driving circuit 140.

As described in greater detail above, when the control signal converting circuit 130 is installed in the timing controller 160, a number of required components of the LCD 105 according to an exemplary embodiment is substantially reduced.

Figure 6:
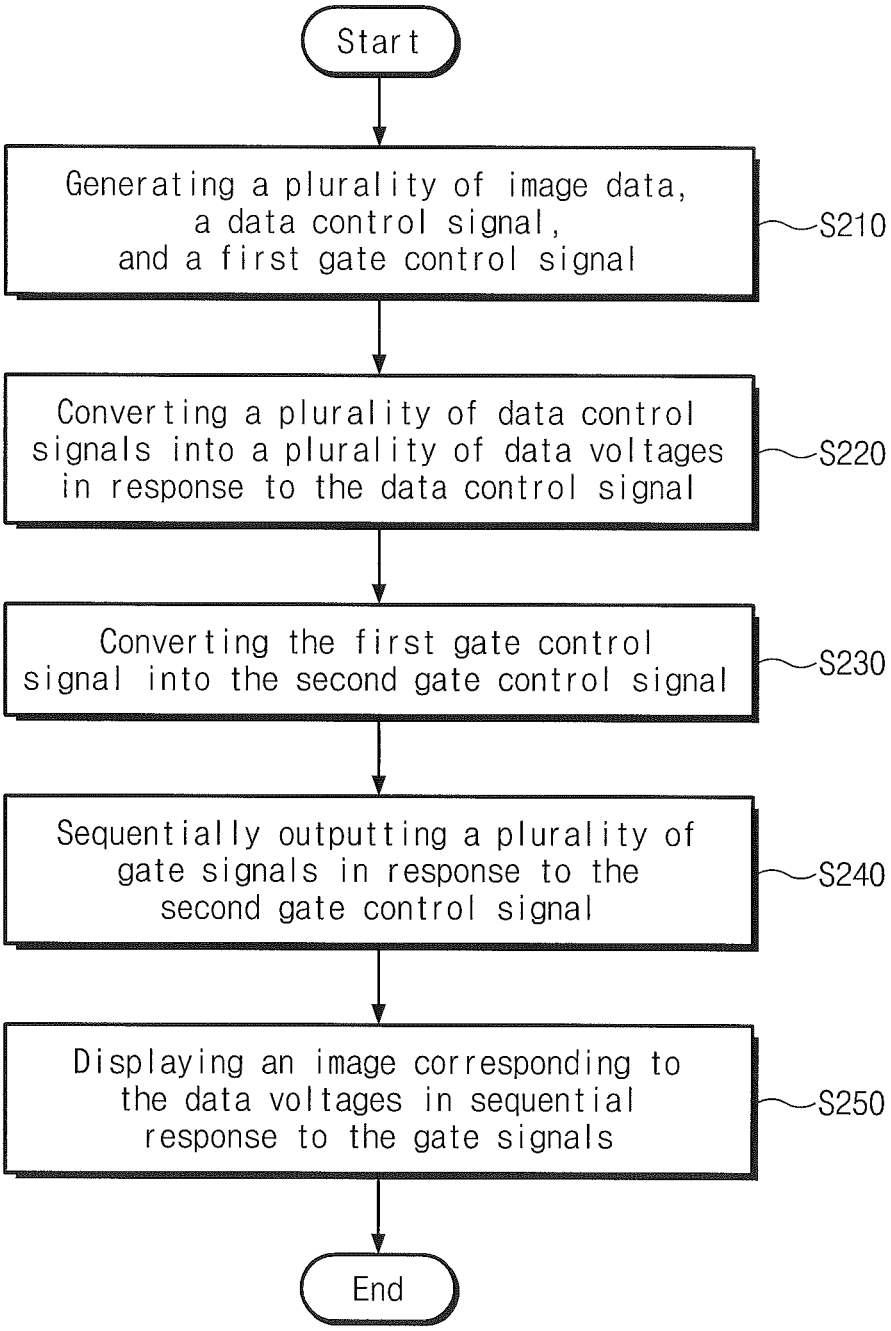
FIG. 6 is a flowchart illustrating an exemplary embodiment of a method of driving an LCD according to the present invention.

FIG. 6 is a flowchart illustrating an exemplary embodiment of a method of driving an LCD according to the present invention.

Referring to FIG. 6, the LCD 100 according to an exemplary embodiment (FIG. 1) generates image data, a data control signal and a first gate control signal in step S210. The LCD 100 receives the image data and external control signals (not shown) through the timing controller 110 ( ), converts a data format of the image data into a data format appropriate for the LCD 100, and outputs the data control signal and the first gate control signal based on the external control signals.

Specifically, the LCD 100 converts the image data into data voltages in synchronization with the data control signal in step S220. The LCD 100 generates the data voltages using a data driving circuit 120 and outputs the data voltages corresponding to each line for each horizontal scanning period 1 H.

The LCD 100 converts the first gate control signal into a second gate control signal, delayed by a reference time period t1, (FIG. 3) from the first gate control signal based on a reference signal in step S230. The LCD 100 generates the second gate control signal through the control signal converting circuit 130 and supplies the second gate control signal to the gate driving circuit 140.

The gate driving circuit 140 sequentially outputs gate signals in response to the second gate control signal in step S240.

The liquid crystal panel 150 thereby displays an image corresponding to the data voltages in response to the gate signals in step S250.

According to exemplary embodiments of the present invention as described herein, each gate signal rises after a reference time period from a horizontal scanning period and falls before an ending time point of the horizontal scanning period. Moreover, the reference time period in an exemplary embodiment is less than a time period between a falling time point of a present gate signal and a rising time point of a next gate signal.

As a result, when each gate signal is delayed, each pixel is not affected by a distortion of the common voltage, and, as a result, a crosstalk phenomenon and/or a greenish display phenomenon are substantially reduced and/or effectively prevented, thereby effectively preventing a charging defect from occurring in each pixel.

The present invention should not be construed as being limited to the exemplary embodiments set forth herein. Rather, these exemplary embodiments are provided so that this disclosure will be thorough and complete and will fully convey the concept of the present invention to those skilled in the art.

While the present invention has been particularly shown and described herein with reference to exemplary embodiments thereof, it will be understood by those of ordinary skill in the art that various changes in form and details may be made therein without departing from the spirit or scope of the present invention as defined by the following claims.

What is claimed is:

1. A display apparatus comprising:

a timing controller which outputs image data, a data control signal and a first gate control signal;

a data driving circuit which receives the image data in synchronization with the data control signal and converts the image data into data voltages to output one line of data voltages in each horizontal scanning period;

a control signal converting circuit which delays the first gate control signal by a reference time period to convert the first gate control signal into a second gate control signal based on a reference signal;

a gate driving circuit which sequentially outputs gate signals based on the second gate control signal; and a display panel including pixel rows and which displays an image corresponding to the one line of the data voltages based on the gate signals, wherein each gate signal of the gate signals rises at a point in time delayed from a starting point of a corresponding horizontal scanning period by the reference time period and falls before an ending point of the corresponding horizontal scanning period, wherein the first gate control signal comprises a first vertical clock signal and a first output enable signal, and the second control signal comprises a second vertical clock signal delayed from the first vertical clock signal by the reference time period and a second output enable signal delayed from the first output enable signal, wherein the second vertical clock signal determines a rising time point of the each gate signal and the second output signal determines a falling time point of the each gate signal.

2. The display apparatus of claim 1, wherein the reference time period is less than a time period between a falling point in time of each of the gate signals and a rising point in time of a subsequent gate signal.

3. The display apparatus of claim 2, wherein the reference time period is about 2 μs to about 5 μs.

4. The display apparatus of claim 2, wherein each gate signal has a pulse width such that a time period between a falling point in time of each of the gate signals and a rising point in time of a subsequent gate signal is equal to or greater than about 4 μs.

5. The display apparatus of claim 1, wherein second output enable signal is delayed from the first output enable signal by the reference time period.

6. The display apparatus of claim 5, wherein a time period between a rising time point of the second output enable signal and a rising time point of the second vertical clock signal is equal to or greater than about 4 μs.

7. The display apparatus of claim 1, wherein the data driving circuit converts a polarity of each of the data voltages with respect to a common voltage every one or more horizontal scanning periods.

8. The display apparatus of claim 7, wherein the common voltage is a direct current voltage.

9. The display apparatus of claim 1, wherein the control signal converting circuit is installed inside the timing controller.

10. A method of driving a display apparatus, the method comprising:

generating image data, a data control signal and a first gate control signal;

converting the image data into data voltages in synchronization with the data control signal to output one line of the data voltages each horizontal scanning period;

delaying the first gate control signal by a reference time period based on a reference signal to output a second gate control signal;

sequentially outputting gate signals in response to the second gate control signal; and displaying an image corresponding to the one line of the data voltages in response to the gate signals, wherein each gate signal of the gate signals rises at a point in time delayed by the reference time period from a starting point of a corresponding horizontal scanning period and falls before an ending point of the corresponding horizontal scanning period, wherein the first gate control signal comprises a first vertical clock signal and a first output enable signal, and the second control signal comprises a second vertical clock signal delayed from the first vertical clock signal by the reference time period and a second output enable signal delayed from the first output enable signal, wherein the second vertical clock signal determines a rising time point of the each gate signal and the second output signal determines a falling time point of the each gate signal.

11. The method of claim 10, wherein the reference time period is less than a time period between a falling point in time of each of the gate signals and a rising point in time of a subsequent gate signal.

12. The method of claim 10, wherein second output enable signal is delayed from the first output enable signal by the reference time.

13. The method of claim 12, wherein a time period between a rising time point of the second output enable signal and a rising time point of the second vertical clock signal is equal to or greater than about 4 μs.

14. The method of claim 10, wherein a polarity of each of the data voltages with respect to a common voltage is inverted one or more horizontal scanning periods.

15. The display apparatus of claim 1, wherein the second output enable signal is delayed from the first output enable signal by a time period which is greater than the reference time period.

16. The method of claim 10, wherein the second output enable signal is delayed from the first output enable signal by a time period which is greater than the reference time period.

* * * * *